US009528737B2

(12) United States Patent
Jafa et al.

(10) Patent No.: US 9,528,737 B2
(45) Date of Patent: Dec. 27, 2016

(54) ICE MAKING AND HARVESTING

(71) Applicant: PepsiCo, Inc., Purchase, NY (US)

(72) Inventors: Emad Jafa, Brewster, NY (US); Vasilii Abashkin, St. Petersburg (RU); Andrey Balanev, St. Petersburg (RU); Georgy Martsinovskiy, St. Petersburg (RU); Vladimir Vasiliev, St. Petersburg (RU); Mikhail Verbitsky, Stoughton, MA (US)

(73) Assignee: PepsiCo, Inc., Purchase, NY (US)

( * ) Notice: Subject to any disclaimer, the term of this patent is extended or adjusted under 35 U.S.C. 154(b) by 330 days.

(21) Appl. No.: 14/068,527

(22) Filed: Oct. 31, 2013

(65) Prior Publication Data

US 2015/0114012 A1 Apr. 30, 2015

(51) Int. Cl.

| | |
|---|---|
| ***F25C 5/02*** | (2006.01) |
| ***F25C 1/12*** | (2006.01) |
| ***F25C 1/04*** | (2006.01) |
| ***F25C 1/06*** | (2006.01) |
| ***F25C 5/04*** | (2006.01) |
| ***F25C 1/18*** | (2006.01) |
| ***F25C 1/22*** | (2006.01) |

(52) U.S. Cl.

CPC . *F25C 1/12* (2013.01); *F25C 1/04* (2013.01); *F25C 1/045* (2013.01); *F25C 1/06* (2013.01); *F25C 1/18* (2013.01); *F25C 1/225* (2013.01); *F25C 5/02* (2013.01); *F25C 5/04* (2013.01)

(58) Field of Classification Search

CPC ..... F25C 1/04; F25C 1/045; F25C 1/06; F25C 1/12; F25C 5/02; F25C 5/04

See application file for complete search history.

(56) References Cited

U.S. PATENT DOCUMENTS

| | | | | |
|---|---|---|---|---|
| 3,024,117 A | | 3/1962 | Barlow | |
| 3,043,117 A | * | 7/1962 | Bollefer | F25C 1/045 62/344 |
| 4,100,760 A | | 7/1978 | Cheney | |

(Continued)

FOREIGN PATENT DOCUMENTS

| | | | | |
|---|---|---|---|---|
| DE | 929370 C | * | 6/1955 | F25C 1/06 |

OTHER PUBLICATIONS

International Search Report and Written Opinion of the International Searching Authority for International Application No. PCT/US2014/063136, dated Feb. 19, 2015 (7 pages).

*Primary Examiner* — Orlando Aviles Bosques

(74) *Attorney, Agent, or Firm* — Sterne, Kessler, Goldstein & Fox P.L.L.C.

(57) ABSTRACT

An ice making and harvesting apparatus includes a mold, and bottom and top plates. The mold includes a plurality of cells. Each cell includes side walls and defines bottom and top openings. The bottom plate is configured to move relative to a bottom surface of the mold. An upper surface of the bottom plate includes a first sealing component. A bottom side of the mold includes a second sealing component. The second sealing component is configured to form a seal with the first sealing component of the bottom plate. The bottom plate includes an inlet and a plurality of channels. Each channel is configured to supply water from the bottom plate to a corresponding cell of the mold. The top plate includes a plurality of pushing rods, each rod configured to move relative to the top opening of a corresponding cell.

21 Claims, 9 Drawing Sheets

(56) References Cited

U.S. PATENT DOCUMENTS

| | | | |
|---|---|---|---|
| 4,748,817 | A | 6/1988 | Oura et al. |
| 5,618,463 | A | 4/1997 | Rindler et al. |
| 6,000,229 | A | 12/1999 | Jones et al. |
| 6,574,981 | B2 | 6/2003 | Schroeder |
| 6,588,219 | B2 | 7/2003 | Zevlakis |
| 6,688,117 | B1 | 2/2004 | Ophir |
| 6,761,036 | B2 | 7/2004 | Teague et al. |
| 7,213,411 | B2 | 5/2007 | Maier-Laxhuber et al. |
| 7,415,833 | B2 | 8/2008 | Leaver et al. |
| 7,591,140 | B2 | 9/2009 | Franck et al. |
| 7,596,964 | B2 | 10/2009 | Lim et al. |
| 7,861,551 | B2 | 1/2011 | Hortin |
| 7,870,749 | B2 | 1/2011 | Franck et al. |
| 7,908,871 | B2 | 3/2011 | Baxter et al. |
| 2003/0056524 | A1 | 3/2003 | Schroeder |
| 2003/0101735 | A1 | 6/2003 | Teague et al. |
| 2003/0106327 | A1 | 6/2003 | Zevlakis |
| 2004/0099004 | A1 | 5/2004 | Somura |
| 2004/0206250 | A1 | 10/2004 | Kondou et al. |
| 2005/0061022 | A1 | 3/2005 | Maier-Laxhuber et al. |
| 2007/0107447 | A1 | 5/2007 | Langlotz |
| 2007/0163286 | A1 | 7/2007 | Lim et al. |
| 2007/0210105 | A1 | 9/2007 | Malachowsky et al. |
| 2009/0025399 | A1 | 1/2009 | Kamen et al. |
| 2009/0301106 | A1 | 12/2009 | Franck et al. |
| 2011/0041543 | A1 | 2/2011 | Tachibana et al. |
| 2013/0081412 | A1 | 4/2013 | Son et al. |
| 2013/0186113 | A1 | 7/2013 | Chung et al. |

* cited by examiner

ICE MAKING AND HARVESTING

FIELD OF THE INVENTION

This disclosure relates generally to an ice making and harvesting apparatus and method, wherein the ice may be used in a variety of settings, including beverage dispensers, e.g., for cafeterias, restaurants (including fast food restaurants), theatres, convenience stores, gas stations, and other entertainment and/or food service venues, with reduced overall dimensions of apparatus and decreased freezing time for ice.

BACKGROUND

Ice making machines described in the art typically form clear crystalline ice by freezing water that flows over a cooled surface.

Existing ice making machines have several shortcomings. For example, they form ice cubes relatively slowly, which leads to a low ice production rates at a given number of ice forming cells. For example, conventional ice making machines typically have ice production cycles of about 10-15 minutes. In order to provide required ice consumption during peak hours, conventional machines are typically equipped with a large size hopper. During storage, ice in the hopper requires mechanical agitation to avoid freezing of ice cubes together. This noticeably increases complexity and overall dimension of the ice making machine. Very often, a large hopper for ice storage is required, which in turn may require the hopper to be located remotely from the point of dispense. Transportation of ice from a remote location to the point of dispensing may add to complexity and operation of ice making. In addition, ice stored for a significant period of time may become contaminated. Conventional machines are not equipped to provide for harvesting of ice that is commensurate with ice production cycles of less than about 10-15 minutes.

Transparent or clear crystalline ice is produced from deaerated and purified water. In conventional ice making machines, deaeration and purification of water is achieved by slow layer-by-layer ice growth. This conventional process, in addition to being slow to allow layer-by-layer ice growth and adversely affecting ice production cycle, also results in water being wasted due to water evaporation during the slow layer-by-layer growth. During multiple ice production cycles using conventional ice making machines, residual water accumulates salts and impurities, and thus should be periodically drained. This draining of water is another contribution to water waste using conventional ice making machines.

Therefore, there is a need for a new ice making machine, which would provide faster ice cube freezing with less waste of water, and enable close to "ice-on-demand" production and harvesting rates, which in turn translates to a smaller overall machine footprint.

SUMMARY

In an aspect of the disclosure an ice making and harvesting apparatus is provided. The ice making and harvesting apparatus comprises a mold, a bottom plate, and a top plate. The mold comprises a plurality of cells. Each cell comprises four side walls, and each cell defines a bottom opening and a top opening. The bottom plate is configured to move relative to a bottom surface of the mold. An upper surface of the bottom plate faces the mold. The upper surface of the bottom plate comprises a first sealing component. A bottom side of the mold comprises a second sealing component. The second sealing component is configured to form a seal with the first sealing component of the bottom plate. The bottom plate comprises an inlet and a plurality of channels. Each channel is configured to supply water from the bottom plate to a corresponding cell of the plurality of cells of the mold. The top plate comprises a plurality of pushing rods, each pushing rod configured to move relative to the top opening of a corresponding cell.

The above and other aspects, features and advantages of the present disclosure will be apparent from the following detailed description of the illustrated embodiments thereof which are to be read in connection with the accompanying drawings.

DETAILED DESCRIPTION

In an aspect of the disclosure, an ice making and harvesting apparatus may be provided with reduced overall dimensions and decreased freezing time of an ice cube to provide "ice-on-demand" production.

Figure 1:
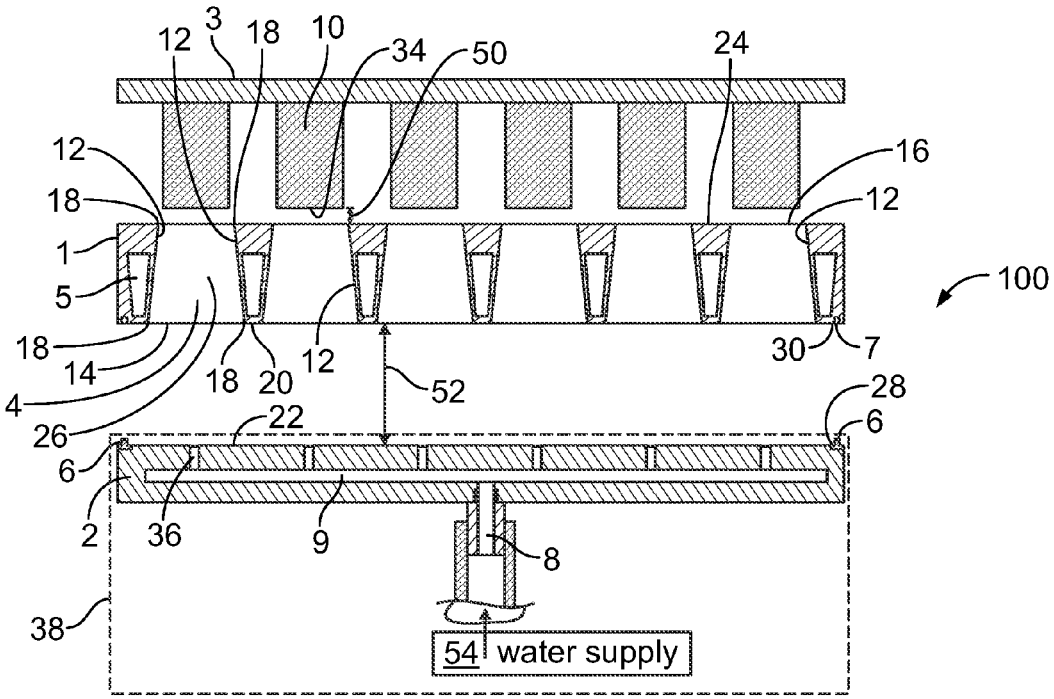
FIG. 1 shows an apparatus in a first stage in accordance with at least one aspect of the disclosure.

In an aspect of the disclosure, an ice making and harvesting apparatus is provided. As shown in FIG. 1, ice making and harvesting apparatus 100 may comprise a mold 1, a bottom plate 2, and a top plate 3. FIG. 1 shows ice making and harvesting apparatus 100 in an initial or first stage. In this first stage, mold 1 may be separated from top plate 3 by distance 50, and mold 1 may be separated from bottom plate 2 by distance 52.

Mold 1 may be made of any suitable material. For example, mold 1 may comprise metal. Mold 1 may be located at a counter, for example, a counter where beverages are dispensed. Mold 1 may comprise a plurality of cells 4 and a plurality of passageways 5. Passageways 5 may be configured to receive a cooling agent (not shown). The cooling agent may be moving continuously through passageways 5 to cool mold 1. The cooling agent may move from passageways 5 to a cooling apparatus (not shown). At the cooling apparatus, the cooling agent may be sufficiently cooled so that when the cooling agent is returned to passageways 5, the cooling agent cools mold 1 and water in mold 1 freezes. Those skilled in the art will recognize that any suitable cooling agent may be used in accordance with aspects of the disclosure. Those skilled in the art will recognize that in accordance with aspects of the disclosure, the cooling agent may be a main refrigerant or first cooling agent that flows through a cooling apparatus (not shown), and may be cooled in a heat exchanger by a secondary refrigerant or second cooling agent. Those skilled in the art will recognize that in accordance with aspects of the disclosure the first and second cooling agents may be food-grade refrigerants. By way of example, but not limitation, the first cooling agent may be a hydrofluorocarbon (HFC), e.g., R-404, and the second cooling agent may be potassium acetate based, high-performance secondary coolant, e.g., Tyfoxit® F.

Each cell 4 of mold 1 comprises four side walls 12 extending from a bottom surface 20 and a top surface 24 of mold 1. Each cell 4 defines a bottom opening 14 and a top opening 16 at edges 18 of side walls 12. As shown in FIG. 1, side walls 12 may taper as they extend from bottom opening 14 to top opening 16 of each cell. Thus, internal volume 26 of each cell 4 may be accessible from bottom opening 14 and top opening 16, respectively. Each side wall 12 may be a parallelogram. Each side wall 12 may have other shapes, including for example but not by limitation, a trapezoid. Walls 12 may comprise a coating, and the coating may be a quick release coating. For example, walls 12 may comprise Teflon®, or similar type of coating.

Bottom plate 2 may comprise an upper surface 22. In an embodiment, upper surface 22 of bottom plate 2 faces bottom surface 20 of mold 1. Bottom plate 2 may be configured to move relative to a bottom surface 20 of mold 1. Movement of bottom plate 2 may be provided by any suitable driving mechanism (not shown). Those of skill in the art will recognize that such suitable driving mechanism may comprise an electro-mechanical or hydraulic or pneumatic driving mechanism. Bottom plate 2 may be configured to move so that its upper surface 22 abuts bottom surface 20 of mold 1. Upper surface 22 of bottom plate 2 may comprise a first sealing component 6. First sealing component 6 may comprise any suitable sealing material. For example, first sealing component 6 may comprise a rubber or elastic material. First sealing component 6 may be attached to bottom plate 2 along the perimeter of upper surface 22 of bottom plate 2. As shown in FIG. 1, first sealing component 6 may comprise a protrusion 28.

Bottom surface 20 of mold 1 may comprise a second sealing component 7. Second sealing component 7 may comprise any suitable sealing material. For example, second sealing component 7 may comprise a rubber or elastic material. Second sealing component 7 may be attached to mold 1 along the perimeter of bottom surface 20 of mold 1. As shown in FIG. 1, second sealing component 7 may define a grove 30. Groove 30 may be configured to receive protrusion 28 and form an interface seal 32 (shown in FIG. 2) between mold 1 and bottom plate 2. Those skilled in the art will recognize that in accordance with the disclosure, first sealing component 6 may be switched with second sealing component 7 so that upper surface 22 of bottom plate 2 may comprise groove 30, and bottom surface of mold 1 may comprise protrusion 28.

In an embodiment, bottom plate 2 may have an inlet 8 and a least one channel 9 configured to supply water to mold cells 4. Channel 9 may comprise channels 36. Channels 36 may be vertical channels. Inlet 8 may be configured to receive water from a water supply source 54. Water supply source 54 may comprise a deaeration and purification device that may be configured to deaerate and purify water prior to being received by inlet 8. Channel 9 may be configured to receive water from inlet 8 and distribute the water to each cell 4 of mold 1.

Top plate 3 may comprise a plurality of pushing rods 10. Each pushing rod 10 may comprise a bottom surface 34. Bottom surface 34 may face top surface 24 of mold 1. As shown in FIG. 1, in the initial or first stage of apparatus 100, bottom surface 34 of at least one pushing rod 10 of top plate 3 may be separated by distance 50 from top surface 24 of mold 1. Top plate 3 may be configured to move relative to top surface 24 of mold 1. Movement of top plate 3 may be provided by any suitable driving mechanism (not shown). Those of skill in the art will recognize that such suitable driving mechanism may comprise an electro-mechanical or hydraulic or pneumatic driving mechanism. Pushing rods 10 may be located coaxially with top cell opening 16.

During operation of apparatus 100, a cooling agent may be continuously pumped with a cooling agent to cool mold 1 so that side walls 4 of the cell have an operation temperature in the range of about −50 degrees C. to about −5 degrees C. In the initial or first stage, as shown in FIG. 1, both the top plate 3 and the bottom plate 2 may be retracted from mold 1.

Figure 2:
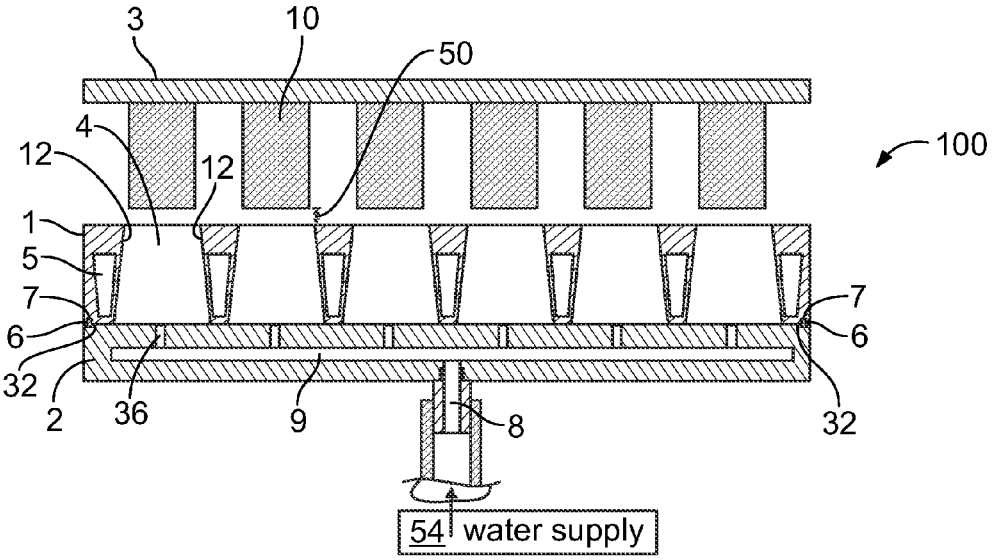
FIG. 2 shows the apparatus in a second stage in accordance with at least one aspect of the disclosure.

As shown in FIG. 2, the operation cycle of the apparatus 100 may comprise moving bottom plate 2 into abutment with mold 1, and providing sealing across the perimeter of the interface seal 32 between mold 1 and bottom plate 2. FIG. 2 shows apparatus in a second stage. In the second stage, bottom plate 2 may be in a closed position due to the sealing across the perimeter of interface seal between mold 1 and bottom plate 2. As shown in FIG. 2, in the second stage, bottom opening 14 of each cell 4 has been closed by bottom plate 2 except for access through bottom opening 14 through channels 36.

Apparatus 100 may comprise a water filling system 38. As shown in FIG. 1, water filling system 38 may comprise water supply source 54, inlet 8 and channel 9, and including channels 36. When apparatus 100 is in the second stage, water filling system 38 may be configured to supply water through inlet 8, and channel 9, and including channels 36 to fill each cell 4 with water.

Figure 3:
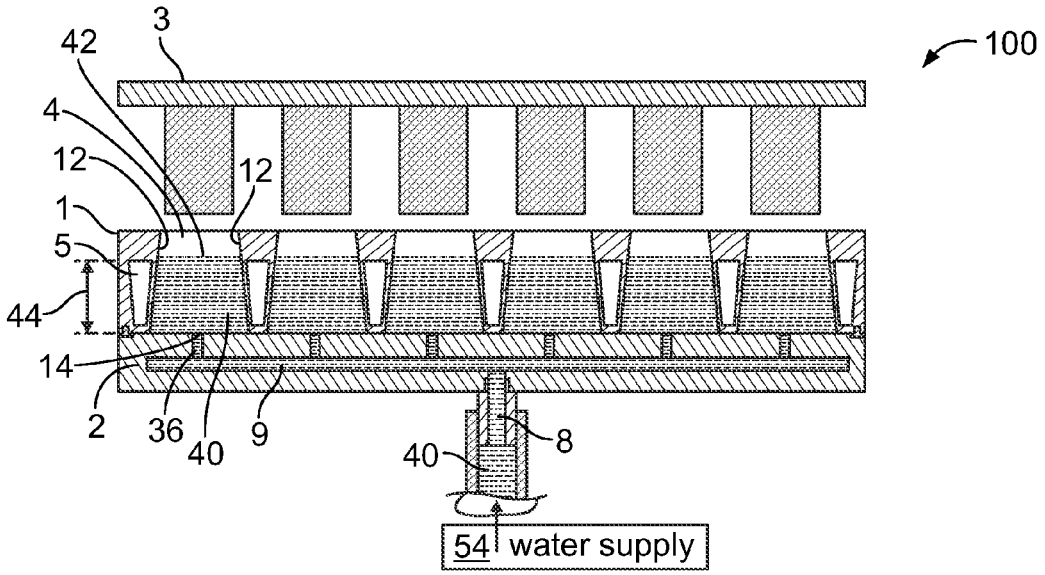
FIG. 3 shows the apparatus in a third stage in accordance with at least one aspect of the disclosure.

In FIG. 3 apparatus 100 is shown in a third stage. In the third stage, the water filling system supplies water 40 through inlet 8, and channel 9, and including channels 36 to fill each cell 4 with water until the water reaches a level 42 that corresponds to a height 44 from bottom opening 14 of each cell 4 to level 42. In accordance with an aspect of the disclosure, the height 44 may be a predetermined height that corresponds to a predetermined height of an ice cube resulting from the freezing of the water in cell 4. Because water expands upon freezing, the predetermined height of an ice cube formed in cell 4 will be greater than height 44 of water in cell 4 prior to freezing.

Figure 4:
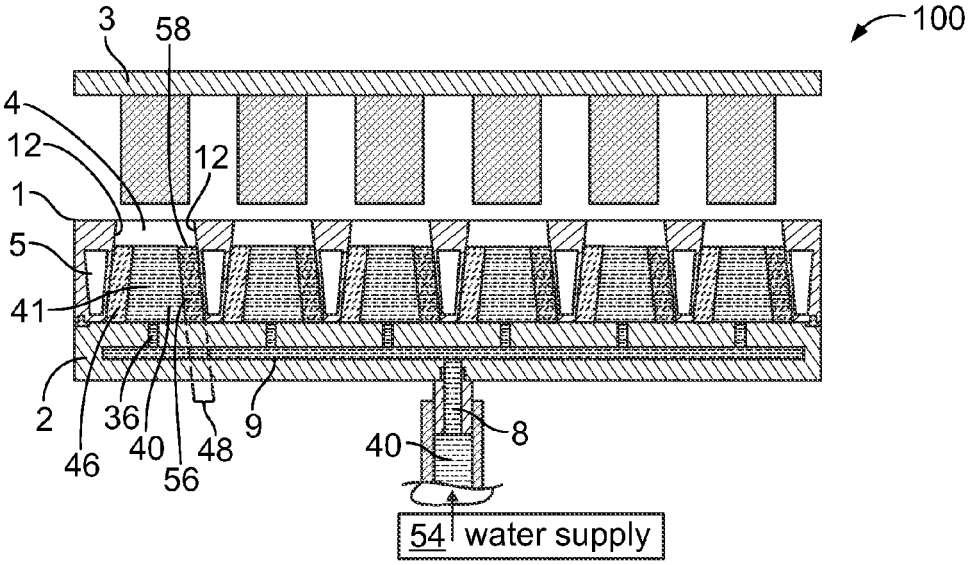
FIG. 4 shows the apparatus in a fourth stage in accordance with at least one aspect of the disclosure.

In FIG. 4 apparatus 100 is shown in a fourth stage. In the fourth stage, ice formation occurs. The cooling agent flowing through passageways 5 of mold 1 removes heat from water 40 in cells 4, thereby freezing the water to form ice 46 on cell walls 12. The freezing time of ice formation cycle may be chosen to provide a predetermined thickness 48 of the wall 56 of ice cube 58. As the freezing time ends and the predetermined ice cubes 58 have been formed, the remaining water 40 may be removed from cells 4. As shown in FIG. 4, ice cubes 58 may comprise a frusto-conical shape. The unfrozen water 40 remaining in cell 4 that may be removed from cells 4 is shown as volume 41 in the embodiment shown in FIG. 4.

Figure 5:
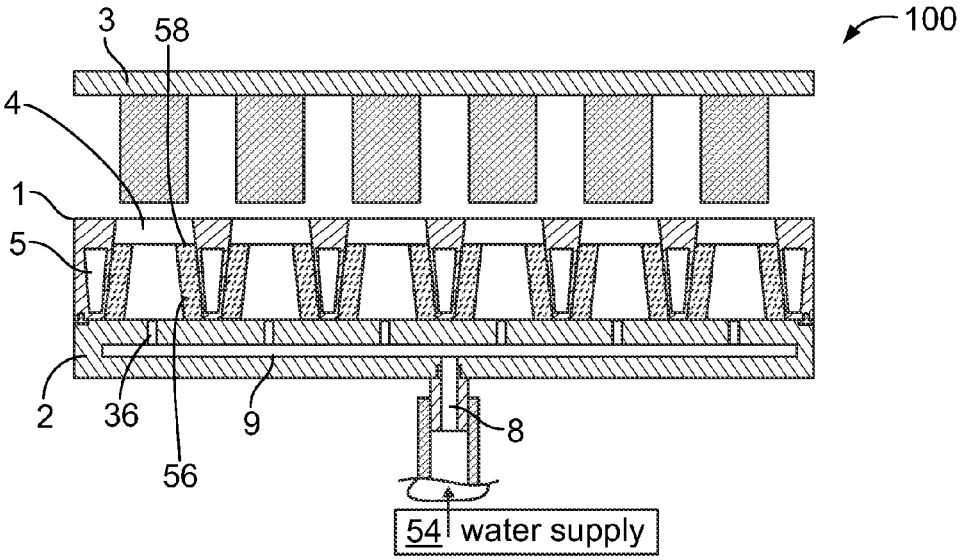
FIG. 5 shows the apparatus in a fifth stage in accordance with at least one aspect of the disclosure.

The removal of remaining water 40 from cells 4 occurs in a fifth stage, which is shown in FIG. 5. In FIG. 5, remaining water 40 shown in FIG. 4 has been removed from cells 4, leaving ice cubes 58 in cells 4. The remaining water 40 shown in FIG. 4 may be removed from cells 4 by stopping the flow of water from water supply source 54 to cells 4, and allowing the remaining water 40 shown in FIG. 4 to drain away from and out of cells 4 through channel 9, including channels 36, and inlet 8 in the opposite direction from the third stage, i.e., the water filling stage, shown in FIG. 3.

Figure 6:
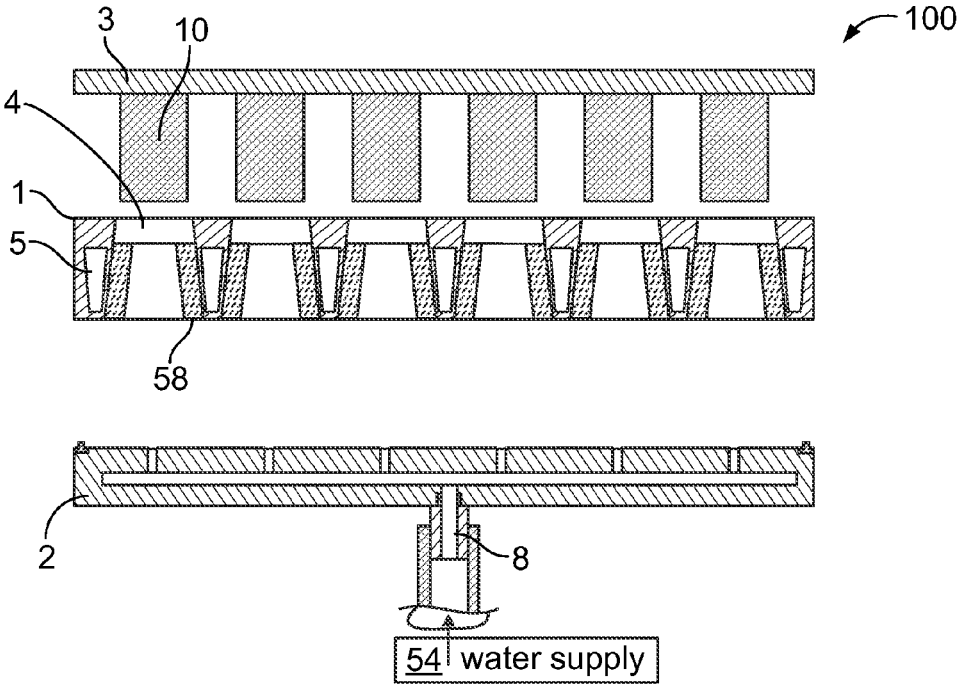
FIG. 6 shows the apparatus in a sixth stage in accordance with at least one aspect of the disclosure.

FIG. 6 shown apparatus 100 in the sixth stage. In the sixth stage, bottom plate 2 may be moved away from mold 1 so that it no longer abuts mold 1. The driving mechanism used to move bottom plate 2 into abutment with mold 1 may be configured to move bottom plate 2 away from abutment with mold 1.

Figure 7:
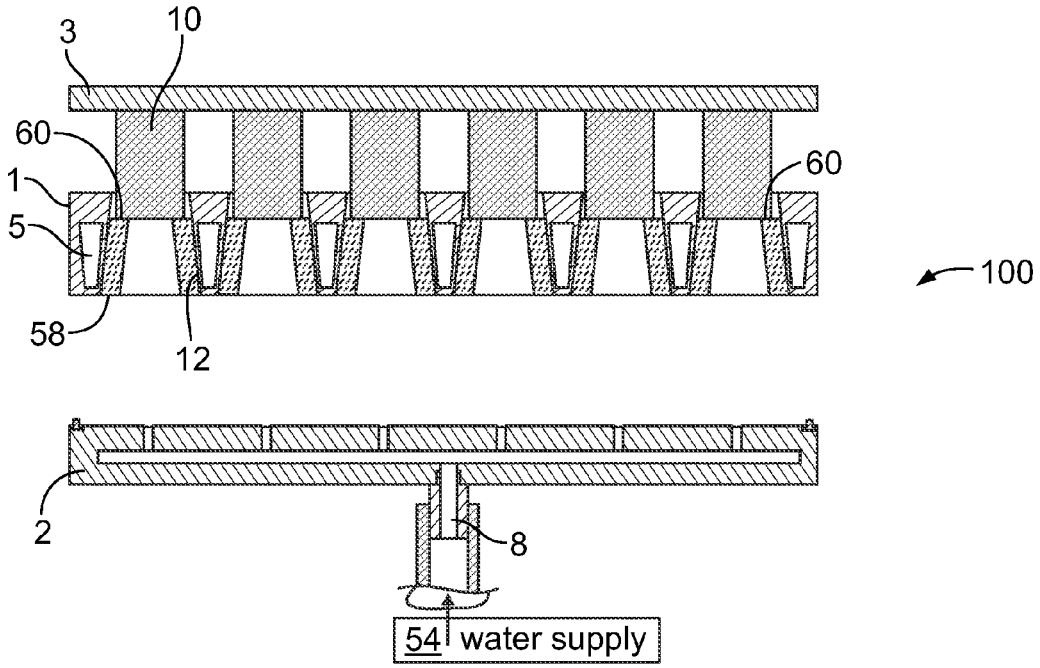
FIG. 7 shows the apparatus in a seventh stage in accordance with at least one aspect of the disclosure.

At the same moment or a moment after bottom plate 2 may be moved away from mold 1, top plate 3 may begin to move down to mold 1 by the driving mechanism corresponding to top plate 3. FIG. 7 shows apparatus 100 in the seventh stage. In the seventh stage, pushing rods 10 penetrate into cells 4 and press or push against upper ends 60 of ice cubes 58. The pressure exerted by pushing rods 10 against upper ends 60 of ice cubes 58 may be about 1 to 35 kg depending on the material of the cell wall and its finishing quality, and the ice cubes 58 begin to be disengaged from the side walls 12 of cells 4, and the ice cubes 58 begin to move down cells 4.

Figure 8:
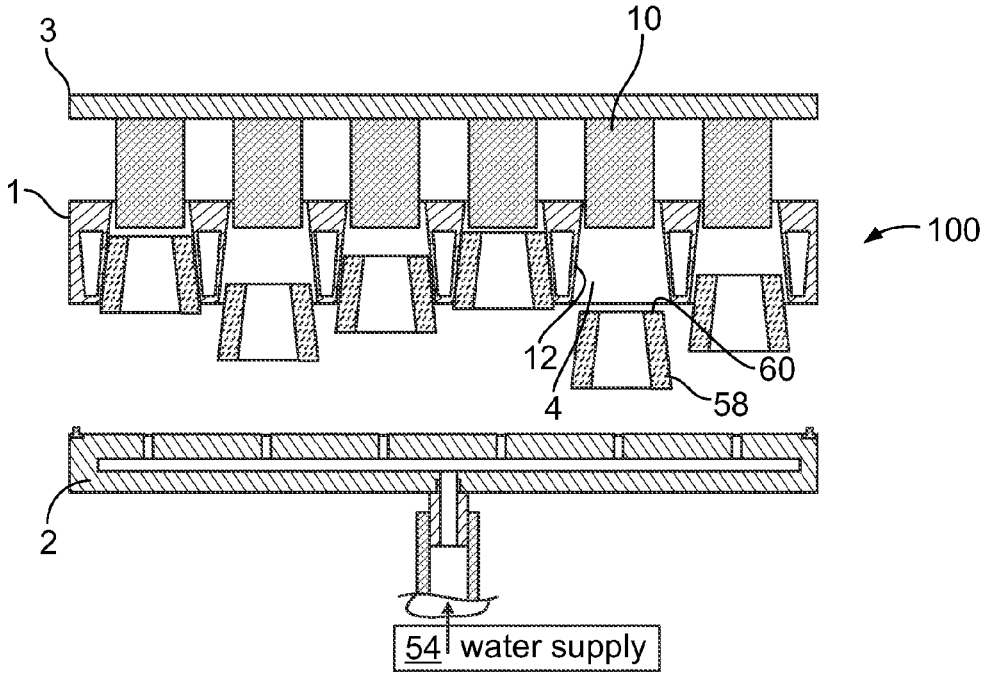
FIG. 8 shows the apparatus in an eighth stage in accordance with at least one aspect of the disclosure.

FIG. 8 shows apparatus 100 in the eighth stage. In the eighth stage, disengagement of ice cubes 58 from side walls 12 of cells 4, and movement of ice cubes 58 down cells 4 resulting in removal of ice cubes 58 occurs. After all of the ice cubes 58 have been removed from cells 4 of mold 1, top plate 3 may be moved back to its initial or first position shown in FIG. 1.

Figure 9:
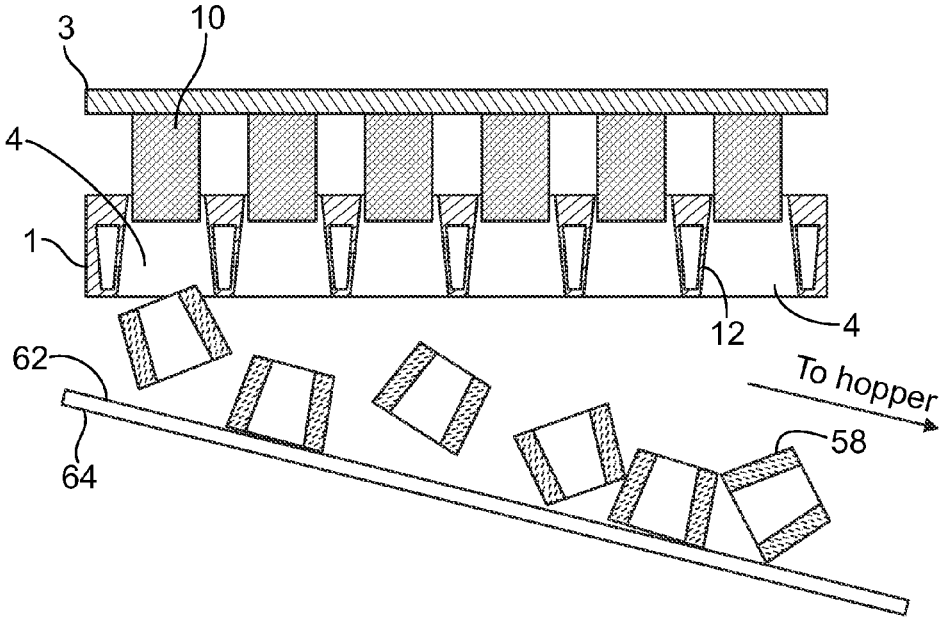
FIG. 9 shows an embodiment wherein ice cubes are directed to an ice hopper in accordance with at least one aspect of the disclosure.

As shown in FIG. 9, in accordance with aspects of the disclosure, a surface 62 may be used to direct movement of ice cubes 58 from cells 4 to an ice hopper (not shown in FIG. 9). Those skilled in the art will recognize that surface 62 may comprise or be a part of any suitable device or element to direct movement of ice cubes 58. For example, as shown in FIG. 9, ramp 64 may comprise surface 62, and surface 62 may be inclined to direct movement of ice cubes 58 to an ice hopper (not shown in FIG. 9). FIG. 9 shows a particular ice cube 58 as it is directed left to right in a tumbling manner from the furthest left cell 4 of mold 1 and down surface 62. In an embodiment, a conveyor belt may comprise surface 62.

Figure 10:
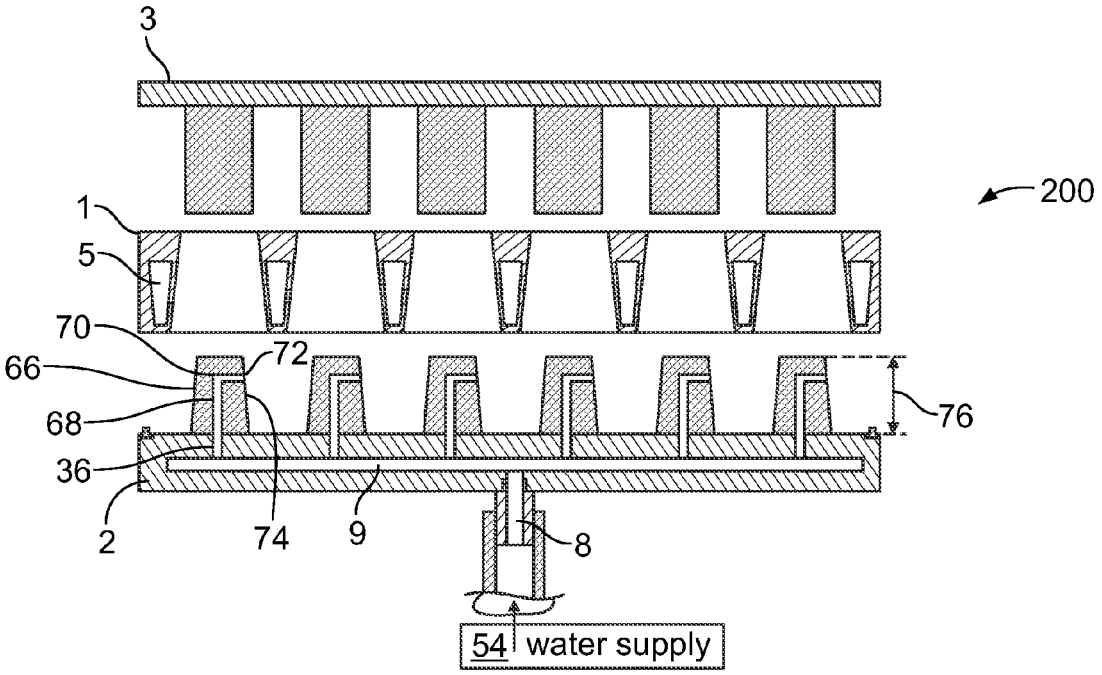
FIG. 10 shows an embodiment wherein inserts are used to reduce the amount of water used to make ice cubes in accordance with at least one aspect of the disclosure.

In accordance with aspects of the disclosure, the amount of water needed to make ice cubes may be reduced by using inserts. FIG. 10 shows apparatus 200. Apparatus 200 may be the same as apparatus 100 previously described, except that bottom plate 2 may comprise inserts 66. Each insert 66 may be located on top surface 22 of bottom plate 2, and coaxially with a corresponding mold cell 4. Each insert may comprise a water filling channel 68. Each water filling channel 68 may be configured to be in fluid communication with a corresponding channel 36. Each water filling channel may comprise a bend 70 to direct water to an outlet 72 of a side wall 74 of insert 66. The height 76 of each insert 66 may correspond to a predetermined height of the ice cube 58 to be formed in cell 4. In an embodiment, height 76 may be slightly greater than a predetermined height of the ice cube to be formed in cell 4 to ensure that there is no freezing of ice on top of insert 66.

Figure 11A:
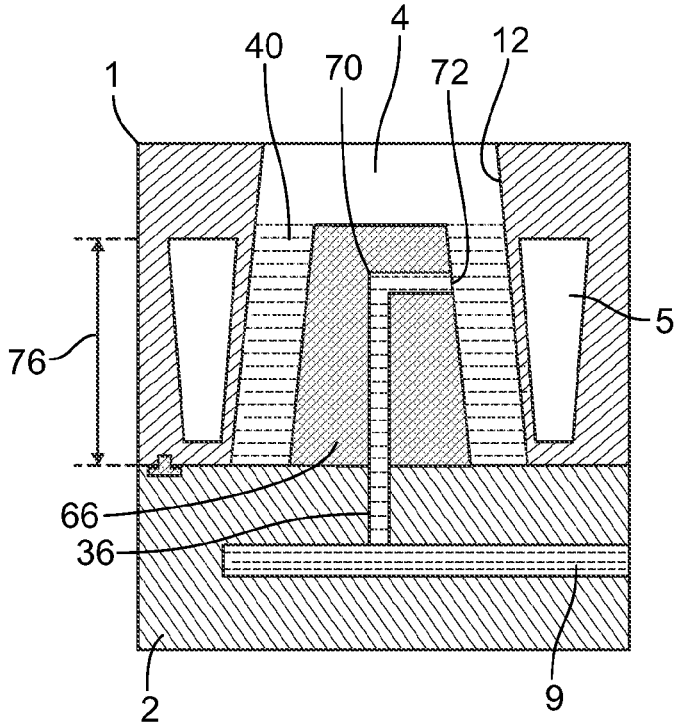
FIG. 11A is a cutaway view that shows the filling of water in a cell using an insert in accordance with at least one aspect of the disclosure.

FIG. 11A is a cutaway view that shows the filling of water 40 in a cell 4 using insert 66. As shown in FIG. 11A, during water filling of cell 4, water 40 flows from channel 9, to channel 36, to bend 70, and to outlet 72. Upon exiting outlet 72 of side wall 74 of insert 66, water 40 fills cell 4 to a predetermined level 76.

Figure 11B:
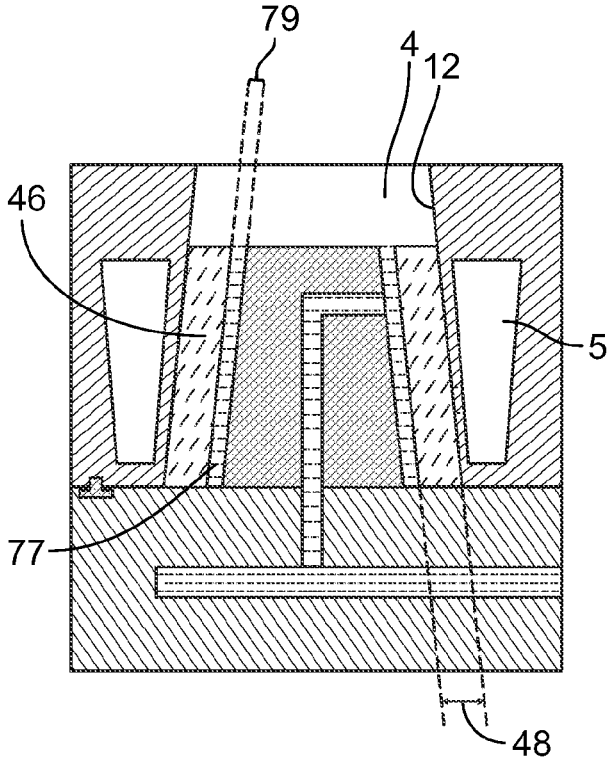
FIG. 11B is a cutaway view that shows the cell shown in FIG. 11A after ice has formed on a cell wall in accordance with at least one aspect of the disclosure.

FIG. 11B is a cutaway view that shows cell 4 after ice 46 has formed on cell wall 12. Due to the volume of insert 66 taking up space within cell 4, the amount of water remaining in cell 4 that needs to be removed from cell 4 before ice cube 58 is removed from cell 4 may be reduced. A comparison of FIG. 11B and a similarly sized cell 4 depicted in FIG. 4 shows the amount of water remaining after an ice cube is formed in cell 4 is less in FIG. 11B than that shown in FIG. 4 due to the volume taken up by insert 66 in FIG. 11B that is not present in the embodiment shown in FIG. 4. The layer of ice 46 formed on the walls 12 of cell 4 may have the same thickness 48 as that shown in the embodiment shown in FIG. 4. After ice 46 has formed on cell wall 12, the water 40 remaining in cell 4 is water layer 77. Water layer 77 has a thickness 79. The combined volume of water layer 77, with the water 40 remaining in insert 66 is less than the volume 41 of water 40 remaining in cell 4 in the embodiment shown in FIG. 4.

Figure 12:
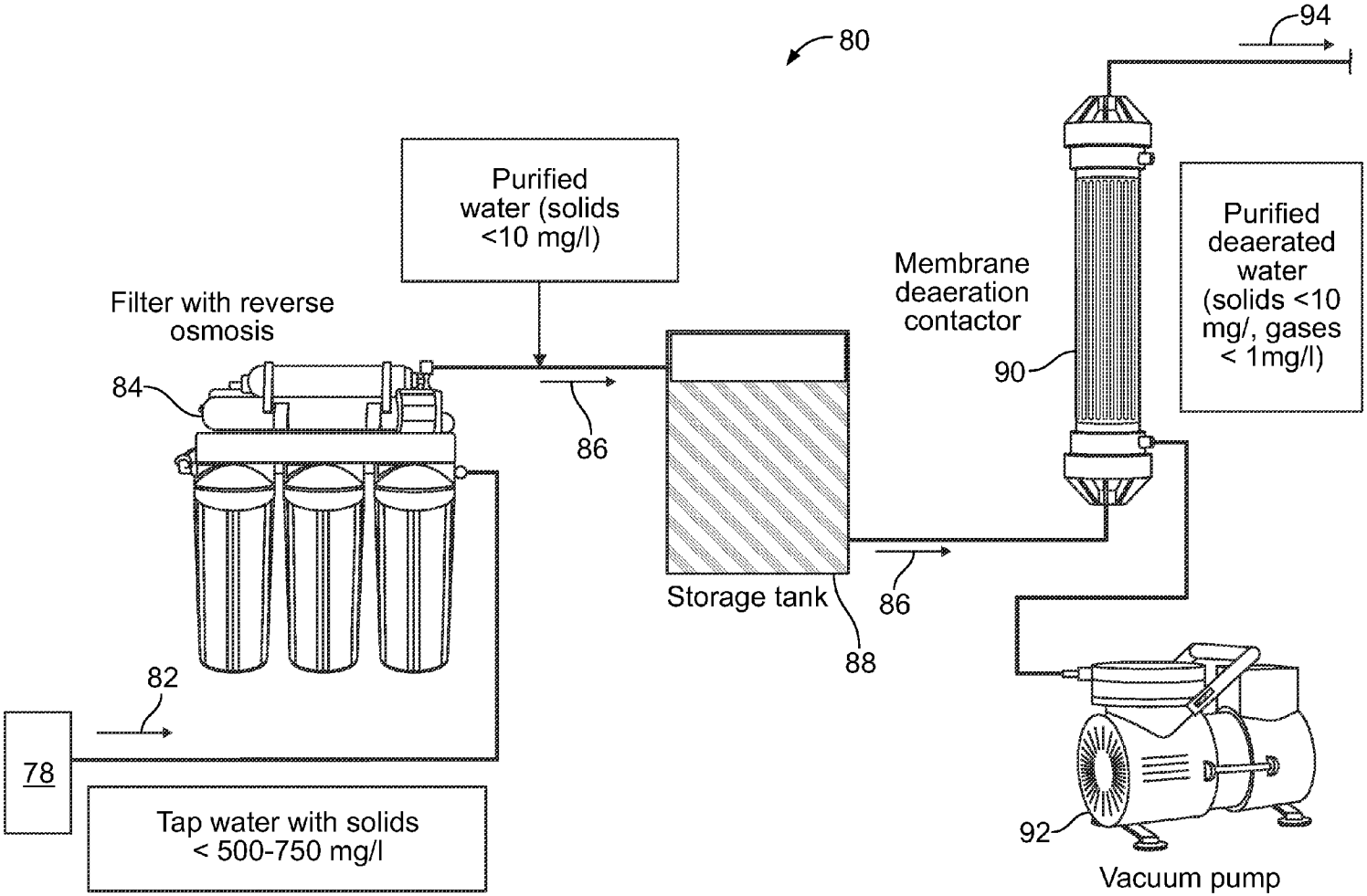
FIG. 12 shows a schematic of a water treatment system in accordance with at least one aspect of the disclosure.

FIG. 12 shows a water treatment system 80. Water treatment system 80 may comprise a source 78 of tap water 82, and a filter 84. Filter 84 may be any suitable filter that is configured to reduce the amount of solids in tap water 82, so that the filtered or purified water 86 exiting filter 84 has a lower amount of solids than the tap water entering filter 84. For example, the amount of solids in tap water 82 may be greater than about 500-750 mg/l prior to flowing through filter 84, but in the amount of solids in the filtered or purified water 86 exiting filter 84 may be less than about 10 mg/l. Filter 84 may comprise at least one reverse osmosis filter and/or at least one ion-exchange filter.

Purified water 86 may flow from filter 84 to storage tank 88. Purified water 86 may flow from storage tank 88 to membrane deaeration contactor 90. In membrane deaeration contactor 90, air in purified water 86 may be removed. To facilitate removal of air from purified water 86, a vacuum pump 92 may be used to pull air out of purified water 86. The water 94 exiting membrane deaeration contactor 90 has, in addition to solids being less than about 10 mg/l, has gases that are less than about 1 mg/l. Water 94 exiting membrane deaeration contactor 90 may be characterized as purified deaerated water 94. Purified deaerated water 94 may be used as water for supplying water for forming beverages, and/or used as water 40 for supplying water to the cells 4 are previously described for the making and harvesting of ice cubes in accordance with aspects of the disclosure. In the latter case, water treatment system 80 is the water supply source 54 shown in FIG. 1.

Figure 13:
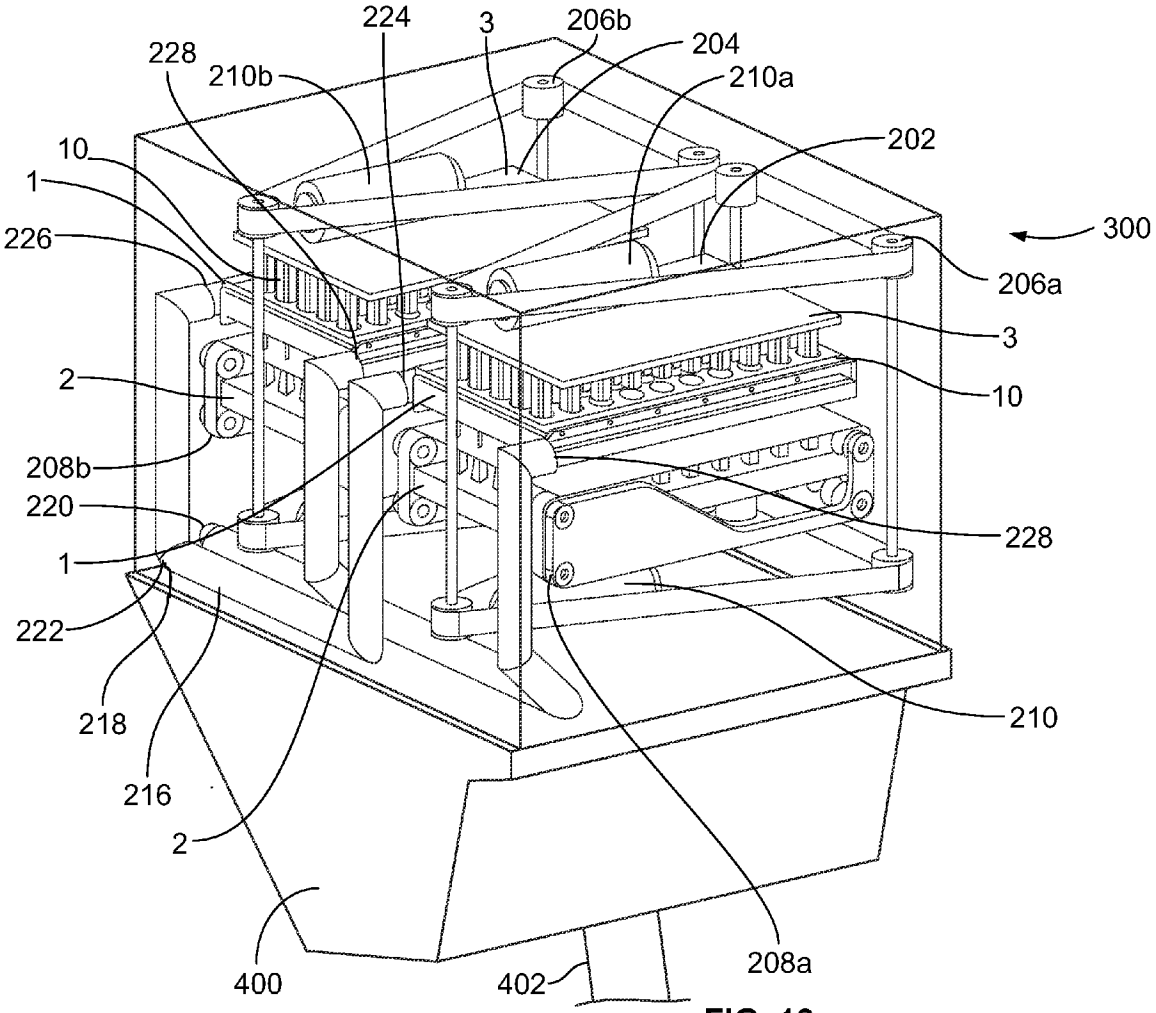
FIG. 13 is a perspective view of an ice making and harvesting apparatus in accordance with at least one aspect of the disclosure.

FIG. 13 is a perspective view of an ice making and harvesting apparatus 300 in accordance with at least one aspect of the disclosure. Apparatus 300 comprises side-by-side apparatuses 202 and 204. As shown in FIG. 13, apparatuses 202 and 204 may be the same as or similar to apparatus 200 shown in FIG. 10. Alternatively, apparatuses 202 and 204 may be the same as or similar to apparatus 100 shown in FIG. 1. Apparatus 300 may comprise driving mechanisms 208*a* and 208*b*. Driving mechanisms 208*a* and 208*b* may each be configured to move a corresponding bottom plate in relation to a corresponding mold 1. As shown in FIG. 13, driving mechanism 208*a* may comprise a motor 210 that powers driving mechanism 208*a* to move bottom plate 2 in relation to mold 1 of apparatus 202. Driving mechanism 208*b* may have a similar motor (not shown). Apparatus 300 may comprise motors 210*a* and 210*b*. Motors 210*a* and 210*b* may each be configured to power a corresponding driving mechanism 206*a*, 206*b* that moves a corresponding top plate 3 in relation to mold 1. The corresponding driving mechanism configured to move top plate 3 in relation to a corresponding mold 1 may be similar to the driving mechanism 208*a*, 208*b* that is configured to move bottom plate 2 in relation to a corresponding mold 1.

As shown in FIG. 13, apparatus 300 may comprise a cooling agent manifold 216. Cooling agent manifold 216 may comprise an inlet 218, and an outlet 220. A suitable cooling agent may enter inlet 218, and then split at juncture 222, with half of the cooling agent being directed inlet 224 of mold 1 of apparatus 202, and the other half of the cooling agent being directed to inlet 226 of mold 1 of apparatus 204. The cooling agent flowing through mold 1 of apparatus 202 may exit that mold at corresponding outlet 228. The cooling agent flowing through mold 1 of apparatus 204 may exit that mold at corresponding outlet 228. The cooling agent exiting each mold 1 may be combined and flow to outlet 220. From outlet 220, the cooling agent may be sent to a cooling apparatus (not shown) that may be configured to cool the cooling agent to a sufficient temperature so that when the cooling agent is sent back to each mold 1 of apparatuses 202 and 204, the cooling agent will cool and freeze water in cells 4 of each mold 1.

Each mold 1 of apparatuses 202 and 204 may comprise water supply inlets (not shown). Water supply inlets may be configured to be in fluid communication with water supply source 54 and/or water treatment system 80. Water supply inlets may also be configured to be in fluid communication with inlet 8 and/or channel 9 and/or channels 36 in accordance with aspects of the disclosure.

Apparatus 300 may comprise an ice hopper 400. Hopper 400 may be configured to receive ice cubes from mold 1 of apparatuses 202 and 204, respectively. Hooper 400 may comprise an outlet pipe 402. Outlet pipe 402 may be configured to receive ice from hopper 400 and direct the ice to an ice dispenser (not shown).

Apparatus 300 may be located at a counter, for example, a counter where beverages may be dispensed. Apparatus 300 may be located above a counter so that ice may be dropped from hopper 400 to an ice dispenser and into a container, e.g., a cup, placed under the ice dispenser. Alternatively, apparatus 300 may be located at a standalone beverage dispenser.

Figure 14:
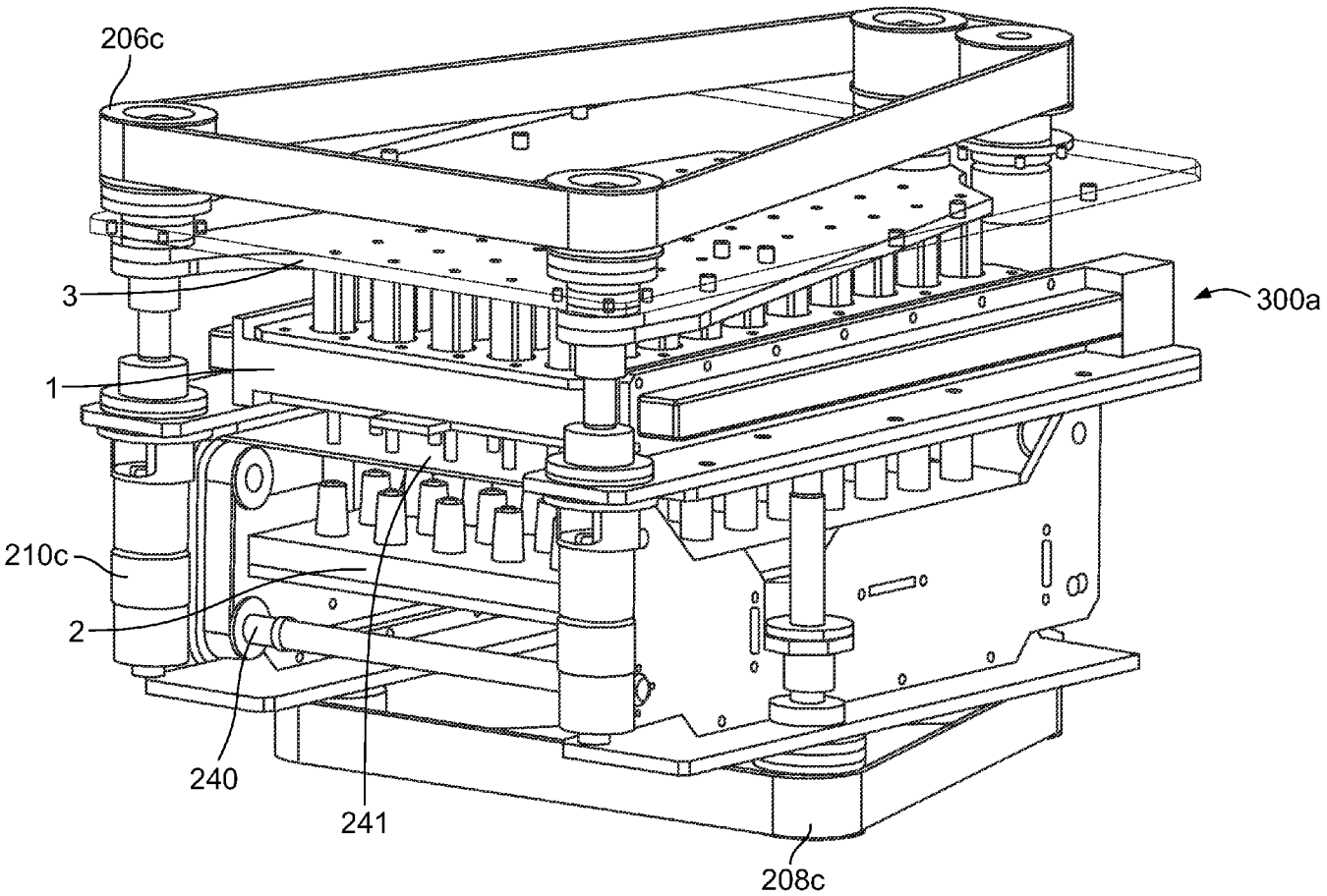
FIG. 14 is a perspective view of an ice making and harvesting apparatus in accordance with at least one aspect of the disclosure.

FIG. 14 is a perspective view of an ice making and harvesting apparatus 300*a* in accordance with at least one aspect of the disclosure. Apparatus 300*a* may be the same as or similar to apparatus 300, apparatus 202, and/or apparatus 204 shown in FIG. 13. Apparatus 300*a* may comprise driving mechanisms 206*a* and 208*a*. Driving mechanisms 206*a* and 208*a* may each be configured to move a corresponding plate in relation to a corresponding mold 1. As shown in FIG. 14, driving mechanism 206*c* may comprise a motor 210*c* that powers driving mechanism 206*c* to move top plate 3 in relation to mold 1. Driving mechanism 208*c* may have a similar motor (not shown). Motors (not shown in FIG. 14) may be configured to power a corresponding driving mechanism 240 of conveyor 241 that moves released ice cubes into a hopper, e.g., hopper 400 shown in FIG. 13, which may be positioned below apparatus 300*a*.

As will be recognized by those skilled in the art, the above described embodiments may be configured to be compatible with fountain system requirements, and can accommodate a wide variety of fountain offerings, including but not limited beverages known under any PepsiCo branded name, such as Pepsi-Cola®, and custom beverage offerings. The embodiments described herein offer speed of service at least and fast or faster than conventional systems. The embodiments described herein may be configured to be monitored, including monitored remotely, with respect to operation and supply levels. The embodiments described herein are economically viable and can be constructed with off-the-shelf components, which may be modified in accordance with the disclosures herein.

Those of skill in the art will recognize that in accordance with the disclosure any of the features and/or options in one embodiment or example can be combined with any of the features and/or options of another embodiment or example.

The disclosure herein has been described and illustrated with reference to the embodiments of the figures, but it should be understood that the features of the disclosure are susceptible to modification, alteration, changes or substitution without departing significantly from the spirit of the disclosure. For example, the dimensions, number, size and shape of the various components may be altered to fit specific applications. Accordingly, the specific embodiments illustrated and described herein are for illustrative purposes only and the disclosure is not limited except by the following claims and their equivalents.

We claim:

1. An ice making apparatus comprising:

a mold comprising a bottom surface, a top surface, and a plurality of cells, wherein each cell comprises side walls and each cell defines a bottom opening and a top opening;

a bottom plate, the bottom plate configured to move relative to the bottom surface of the mold, the bottom plate further comprising an upper surface, the upper surface of the bottom plate configured to face the bottom surface of the mold, the upper surface of the bottom plate comprising a first sealing component, the bottom plate further comprising an inlet and a plurality of channels, each channel configured to supply water from the bottom plate to a corresponding cell of the plurality of cells of the mold;

a top plate, the top plate comprising a plurality of pushing rods, each pushing rod configured to move relative to the top opening of a corresponding cell to push a corresponding ice cube formed in said corresponding cell; and a plurality of passageways, wherein each passageway is disposed within a corresponding side wall of said side walls, each passage way configured to receive a circulating cooling agent.

wherein the bottom surface of the mold comprises a second sealing component, the second sealing component configured to form a seal with the first sealing component of the bottom plate.

2. The ice making apparatus of claim 1, wherein the circulating cooling agent is received in the mold at a sufficiently low first temperature to remove heat from water in contact each of the side walls to freeze the water at each of the side walls.

3. The ice making apparatus of claim 2, further comprising a cooling apparatus, the cooling apparatus configured to supply the cooling agent to the mold.

4. The ice making apparatus of claim 3, wherein the bottom plate has an inlet, the inlet configured to receive water from a water supply source and convey the water to the plurality of channels.

5. The ice making apparatus of claim 4, wherein the apparatus is in a first stage when the bottom plate is a first predetermined distance from the bottom surface of the mold, and the top plate is a second predetermined distance from the top surface of the mold.

6. The ice making apparatus of claim 5, wherein the apparatus is in a second stage when the bottom plate abuts the bottom surface of the mold, and the second sealing component of the mold forms a seal with the first sealing component of the bottom plate.

7. The ice making apparatus of claim 6, wherein the apparatus is in a third stage when the plurality of cells are filled to a predetermined level with water.

8. The ice making apparatus of claim 7, wherein the apparatus is in a fourth stage when the circulating cooling agent has sufficiently cooled water to form a layer of ice at each side wall of each cell to form an ice cube.

9. The ice making apparatus of claim 8, wherein the apparatus is in a fifth stage when water that was remaining in each cell has been removed from each cell.

10. The ice making apparatus of claim 9, wherein the apparatus is in a sixth stage when the bottom plate has been moved away from the mold.

11. The ice making apparatus of claim 10, wherein the apparatus is in a seventh stage when the top plate is moved in relation to the mold and each pushing rod pushes against the ice cube in a corresponding cell.

12. The ice making apparatus of claim 11, wherein the apparatus is in an eighth stage when at least one ice cube has been pushed out of cell by a corresponding pushing rod.

13. The ice making apparatus of claim 12, wherein the apparatus further comprises a guide surface the guide surface configured to direct ice cubes pushed out of the mold to a hopper.

14. The ice making apparatus of claim 3, further comprising a cooling apparatus, wherein the circulating cooling agent exits the mold at a second temperature, the second temperature being greater than the first temperature, the cooling apparatus configured to receive the circulating cooling agent that exits the mold, the cooling apparatus configured to cool the circulating cooling agent from the second temperature to the first temperature and convey the circulating cooling agent at the first temperature to the mold.

15. The ice making apparatus of claim 1, wherein the side walls comprise a coating.

16. The ice making apparatus of claim 1, further comprising a water treatment system, the water treatment system configured to filter water and reduce the amount of solids in the water to less than 10 mg/l, and deaerate to reduce the amount of gases in the water to less than 1 mg/l, the water treatment system configured to then convey treated water to the inlet of the bottom plate.

17. An ice making apparatus comprising:

a mold comprising a bottom surface, a top surface, and a plurality of cells, wherein each cell comprises side walls and each cell defines a bottom opening and a top opening, the mold further comprising a plurality of passageways within the side walls, each passageway configured to receive a circulating cooling agent to remove heat from water in contact with the side walls to freeze water at the side walls;

a bottom plate, the bottom plate configured to move relative to the bottom surface of the mold, the bottom plate further comprising an upper surface, the upper surface of the bottom plate configured to face the bottom surface of the mold, the upper surface of the bottom plate comprising a first sealing component, the bottom plate further comprising a primary inlet, a plurality of channels, and a plurality of inserts, each insert having a corresponding height and a side outlet, each insert configured to receive water from a corresponding channel and convey the water through the side outlet to a volume between the insert and the side walls of a corresponding cell; and a top plate, the top plate comprising a plurality of pushing rods, each pushing rod configured to move relative to the top opening of a corresponding cell and push an ice cube out of the corresponding cell;

wherein the bottom surface of the mold comprises a second sealing component, the second sealing component configured to form a seal with the first sealing component of the bottom plate.

18. The ice making apparatus of claim 17, wherein the side walls and the inserts comprise a coating.

19. A method for making ice comprising:

moving a bottom plate in relation to a bottom surface of a mold so that when the bottom plate abuts the bottom surface of the mold, and a first sealing component of the bottom plate forms a seal with a second sealing component of the mold;

filling a plurality of cells of the mold with water to a predetermined level;

cooling the water to form a layer of ice at each side wall of each cell and form an ice cube, wherein the cooling comprises circulating a cooling agent through a plurality of passages, wherein each passageway is disposed within a respective side wall of said side walls, each passageway configured to receive the cooling agent to cool the respective side wall;

removing water remaining in each cell that has not frozen;

moving the bottom plate away from the mold;

and moving a top plate comprising a plurality of pushing rods in relation to the mold so that each pushing rod pushes against the ice cube in a corresponding cell so that the ice cube exits out a bottom opening of the cell.

20. The method of claim 19 further comprising collecting ice cubes in a hopper that exit from the bottom opening of each cell.

21. The method of claim 20 wherein the circulating comprises circulating the cooling agent between the mold and a cooling apparatus, the circulating comprising cooling the cooling agent by the cooling apparatus to a first temperature from a second temperature of the cooling agent exiting the mold, wherein the second temperature is higher than the first temperature, the circulating further comprising conveying the cooling agent at the first temperature through the passageways in the mold, the circulating further comprising circulating the cooling agent at the second temperature from the mold to the cooling apparatus.

* * * * *